United States Patent [19]

White

[11] 4,405,968

[45] Sep. 20, 1983

[54] CONTROL CIRCUITS

[75] Inventor: Stephen A. White, London, England

[73] Assignee: Lucas Industries plc, Birmingham, England

[21] Appl. No.: 377,587

[22] Filed: May 12, 1982

[30] Foreign Application Priority Data

May 28, 1981 [GB] United Kingdom ..... 8116266

[51] Int. Cl.[3] ..... H01H 47/18

[52] U.S. Cl. ..... 361/195; 219/492; 219/497

[58] Field of Search ..... 361/160, 161, 195, 196; 219/492, 493, 497

[56] References Cited

U.S. PATENT DOCUMENTS 4,283,619 8/1981 Abe ..... 219/492

4,348,583 9/1982 Bube et al. ..... 219/492 X

*Primary Examiner*—Reinhard J. Eisenzopf

[57] ABSTRACT

A control circuit for controlling the operation of an electrically powered heating device includes supply terminals for connection to a source of d.c. supply, one of the terminals of the heating device being connected to one supply terminal and the other terminal of the device being connected to the other supply terminal by way of a relay contact. The junction of the contact and device is connected by way of a resistor to one plate of a capacitor the other plate of which is connected to the one supply terminal. A comparator monitors the voltage across the capacitor and controls the operation of a relay winding. The comparator is supplied with a reference voltage which can be equal to the design operating voltage of the heating device, this being less than the nominal supply voltage. The relative values of the two resistors are chosen so that when the supply voltage exceeds the design voltage the power supplied to the heating device is controlled.

3 Claims, 2 Drawing Figures

CONTROL CIRCUITS

This invention relates to a control circuit for controlling the operation of an electrically powered heating device of the kind intended to be operated for a source of electric supply the terminal voltage of which can vary when the device is in use.

An application for an electrically powered heating device of the aforesaid kind is a starting aid for an internal combustion engine. This may be of the type in which the electric heating element is exposed within the respective combustion chamber of a compression ignition engine or it may be of the type which is disposed in the inlet manifold of the engine and which includes an electric heating element for vaporising and igniting fuel supplied to the aid. It is essential that the aid should reach its operating temperature as quickly as possible so that it becomes effective to assist the starting of the associated engine preferably during the cranking of the engine. The aid is supplied with electric current by the storage accumulator associated with the engine and this is also used to supply electric current to the starting motor of the engine.

When the engine is being cranked the terminal voltage of the accumulator can fall to a value which may be less than half the voltage when the engine is in operation. The rating of the aid must therefore be such that it can attain and hold the desired operating temperature at a low voltage. This means that unless some form of control is effected the desired operating temperature will be exceeded when the engine has started. It is preferable to use a control which switches the aid on and off. The power dissipated in the aid is equal to the voltage applied to the aid multiplied by the current flowing in it multiplied by the mark-space ratio. It is not convenient to try to measure the current however, the power is also equal to the square of the voltage applied to the aid divided by the resistance of the aid and multiplied by the mark-space ratio. At the operating temperature the resistance of the aid will be substantially constant and therefore the control circuit must maintain the mark-space ratio multiplied by the voltage squared, substantially constant in order to provide a substantially constant power. It is not always necessary that the power to the aid should remain constant.

The object of the invention is to provide a control circuit for the purpose specified in a simple and convenient form.

According to the invention a control circuit for the purpose specified comprises first and second terminals for connection to a source of d.c. supply, the first of said terminals in use being connected to one terminal of the heating device, the other terminal of the heating device in use being connected to the second of said terminals by way of switch means, a capacitor having one plate connected to said first terminal and its other plate connected to said second terminal by way of a first resistor, and in use, to the other terminal of said heating device by way of a second resistor, a comparator which compares the voltage developed across said capacitor with a reference voltage and means responsive to the output of said comparator for controlling the operation of said switch means.

Figure 1:
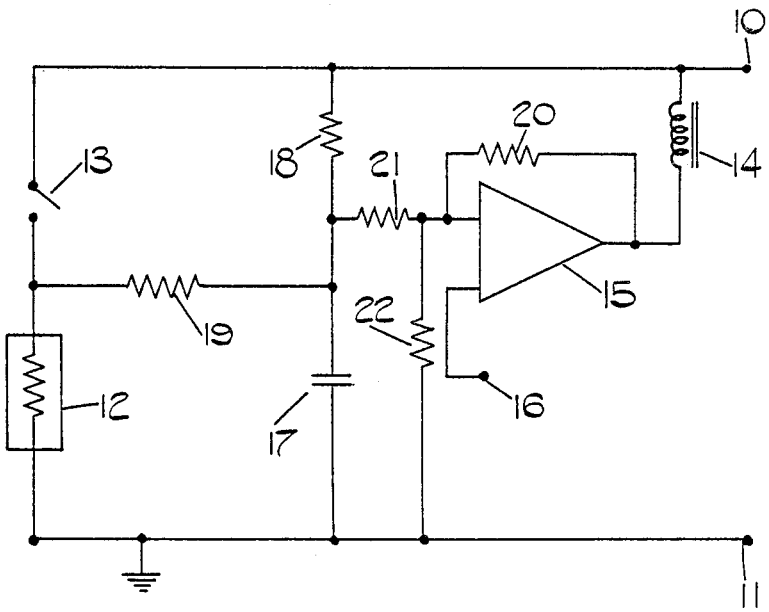
FIG. 1 is an example of a control circuit in accordance with the invention.

Referring to FIG. 1 there is provided a terminal 10 for connection in use to the positive terminal of the storage accumulator associated with the engine of which the starting aid forms part. A terminal 11 is connected to the negative terminal of the accumulator which is earthed. The starting aid is indicated at 12 and it has one terminal connected to the terminal 11 and its other terminal connected by way of a normally open contact 13 of a relay the operating winding of which is indicated at 14. One end of this winding is connected to the terminal 10 and the other end of the winding is connected to the output terminal of a voltage comparator 15 having a pair of input terminals one of which is connected to a terminal 16 which in use, is connected to a reference voltage which lies between the voltages applied to the terminals 10 and 11. The other input of the comparator is connected through a resistor 21, to one plate of a capacitor 17 the other plate of which is connected to the terminal 11. The one plate of the capacitor is connected by way of a first resistor 18 to the supply terminal 10 and by way of a second resistor 19 to the other terminal of the starting aid 12. A resistor 20 is connected between the output terminal of the comparator and the aforesaid other input of the comparator and provides positive feedback to achieve a rapid switching action as will be explained. Moreover, a resistor 22 is connected between the terminal 11 and the other input of the comparator.

In use the terminal 10 is connected to the positive terminal of the storage accumulator when it is desired to energise the starting aid. This connection may be made by the conventional key operated control switch of the engine. Before the connection is made the capacitor 17 is fully discharged by way of the resistor 19 and the starting aid.

When the terminal 10 is connected to the positive terminal of the storage accumulator, since the capacitor voltage is zero the comparator will switch so that its output is low thereby energising the relay winding and causing closure of the contact 13. Electric current now flows in the starting aid and the heating element becomes heated. In addition, the capacitor 17 is charged by way of the resistors 18 and 19 connected in parallel by virtue of the fact that the contact 13 is closed. As the capacitor voltage increases a voltage will be attained depending upon the value of the reference voltage, at which the output of the comparator will go high thereby de-energising the winding 14. The contact 13 will therefore open and the supply of current to the starting aid will cease. With the contact 13 open the resistor 19 is connected in parallel with the capacitor through the starting aid but resistor 18 is still connected to terminal 10. The capacitor will therefore start to discharge at a rate and towards a voltage determined by the supply voltage and the values of the two resistors 18 and 19. In practice however before this voltage is reached the comparator output will again go low, the actual voltage on the capacitor at which this occurs depending upon the reference voltage applied to terminal 16 and the hysteresis of the circuit including the comparator. When the comparator output goes low the relay will be energised and the contact 13 closed so that the starting aid is reconnected to terminal 10 and the capacitor again starts to charge. The process is repeated for as long as the terminals 10 and 11 are connected to the source of supply.

Figure 2:
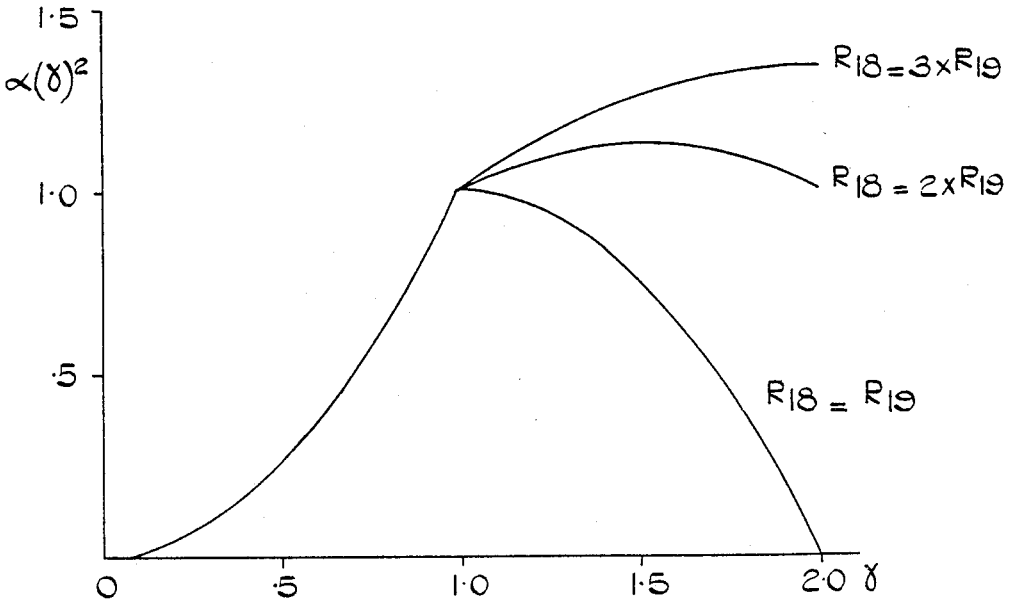
FIG. 2 is a graph showing the operation of the circuit of FIG. 1.

The reference voltage applied to terminal 16 is chosen with the design voltage of the aid in mind together with the values of resistors 21, 22. As previously stated the design voltage is lower than the nominal accumulator voltage in order to ensure that the aid can attain its desired operating temperature when the accumulator voltage is reduced as when the engine starting motor is in operation. The graph shown in FIG. 2 shows the variation in the power supplied to the starting aid as the voltage at the supply terminals varies. The ratio $\gamma$ is the terminal voltage/design voltage and assuming the resistance of the starting aid is constant the relative power is equal to $\gamma^2$ for values of the supply voltage less than or equal to the design voltage and equal to $\alpha\gamma^2$ where $\alpha$ is the percentage "ON" time, when the supply voltage exceeds the design voltage.

It will be seen that when the terminal voltage is above the design voltage the relative power depends upon the relative values of resistors 18 and 19 and if these two resistors have the same value the effect is that the power does in fact decrease as the terminal voltage increases. When the value of resistor 18 is twice the value of resistor 19 an increase of power does take place as the terminal voltage increases from the design voltage but even in this case the power does eventually fall as the terminal voltage continues to increase. In a practical example of the circuit resistor 18 has a value of 47 KOhm and resistor 19 a value of 27 K Ohm, resistors 20, 21 and 22 having the values 470 K Ohm, 68 K Ohm and 100 K Ohm respectively. The capacitor value is 22 $\mu$f. The value of the capacitor is chosen to keep the switching rate as low as possible to minimise the wear of the relay contacts without allowing the starting aid to attain a dangerously high temperature.

I claim:

1. A control circuit for controlling the operation of an electrically powered heating device of the kind intended to be operated from a source of electric supply the terminal voltage of which can vary when the device is in use, the circuit comprising first and second terminals for connection to a source of d.c. supply, the first of said terminals in use being connected to one terminal of the heating device, the other terminal of the heating device in use being connected to the second of said terminals by way of switch means, a capacitor having one plate connected to said first terminal and its other plate connected to said second terminal by way of a first resistor, and in use, to the other terminal of said heating device by way of a second resistor, a comparator which compares the voltage developed across said capacitor with a reference voltage and a relay winding responsive to the output of said comparator for controlling the operation of said switch means.

2. A control circuit according to claim 1, in which the resistance value of the first resistor is higher than that of the second resistor.

3. A control circuit according to claim 1, in which said switch means comprises a relay contact, the flow of current in the relay winding being controlled by said comparator.

* * * * *